US006637694B2

(12) United States Patent
Shibazaki et al.

(10) Patent No.: US 6,637,694 B2
(45) Date of Patent: Oct. 28, 2003

(54) BRAKE STRUCTURE OF BAND REEL IN PACKING MACHINE

(75) Inventors: Tokio Shibazaki, Kawasaki (JP); Tadashi Meguro, Kawasaki (JP); Yosikatsu Aizawa, Kawasaki (JP); Kenichi Enda, Kawasaki (JP)

(73) Assignee: Strapack Corporation, Tokyo (JP)

( * ) Notice: Subject to any disclaimer, the term of this patent is extended or adjusted under 35 U.S.C. 154(b) by 0 days.

(21) Appl. No.: 09/900,653

(22) Filed: Jul. 6, 2001

(65) Prior Publication Data

US 2002/0003184 A1 Jan. 10, 2002

(30) Foreign Application Priority Data

Jul. 7, 2000 (JP) ..... 2000-206639

(51) Int. Cl.[7] ..... B65H 59/04; B65H 59/00

(52) U.S. Cl. ..... 242/421.8; 242/422.4; 242/396.6

(58) Field of Search ..... 242/421.8, 421.9, 242/422.4, 396.6

(56) References Cited

U.S. PATENT DOCUMENTS

| | | | | |
|---|---|---|---|---|
| 2,637,509 A | * | 5/1953 | Stanius | 242/421.8 |
| 2,906,472 A | * | 9/1959 | Hannay et al. | 242/421.8 |
| 3,243,137 A | * | 3/1966 | Norman | 242/421.8 |
| 3,488,933 A | * | 1/1970 | Zimmermann | 242/421.8 |
| 3,826,443 A | | 7/1974 | Goodley | |
| 3,839,939 A | | 10/1974 | Wily | |
| 3,882,757 A | | 5/1975 | Weatherby | |
| 3,912,191 A | * | 10/1975 | Anderson et al. | 242/421.8 |
| 4,106,716 A | * | 8/1978 | Diesch | 242/421.8 |
| 4,124,176 A | * | 11/1978 | Carlson et al. | 242/422.4 |
| 4,350,454 A | * | 9/1982 | Schoenlein | 242/421.8 |
| 4,958,782 A | * | 9/1990 | Dannatt et al. | 242/421.8 |
| 6,079,658 A | * | 6/2000 | Sedimayer | 242/422.4 |

FOREIGN PATENT DOCUMENTS

EP 0 403 878 A 12/1990

* cited by examiner

*Primary Examiner*—Kathy Matecki
*Assistant Examiner*—Sang Kim
(74) *Attorney, Agent, or Firm*—Webb Ziesenheim Logsdon Orkin & Hanson, P.C.

(57) ABSTRACT

A brake structure of a band reel in a packing machine in which reliable braking effects can be obtained and responsiveness can be enhanced. A brake arm (15) has a coil spring portion (16) provided on one of its ends and a band passing ring portion (18) provided on the other end is mounted on one of ends of the reel shaft (13). One of ends on the coil spring (16) side in the brake arm (13) is fastened to a fixed member such as a device frame. The diameter of the coil spring portion (16) is reduced to cause the inner peripheral surface of the coil spring portion (16) to closely engage the outer peripheral surface of the reel shaft (13), thereby stopping rotation of the reel shaft by frictional force, when the force for feeding the band is released.

1 Claim, 5 Drawing Sheets

PRIOR ART

PRIOR ART

BRAKE STRUCTURE OF BAND REEL IN PACKING MACHINE

BACKGROUND OF THE INVENTION

1. Field of the Invention

The present invention relates to a brake structure of a band reel in a packing machine.

2. Description of the Related Art

In an automatic or semi-automatic banding packing machine, a band reel 1 having a long band B wound thereupon is provided in a packing machine body 2 as shown in FIG. 4. A tip of the band B led from the band reel 1 is fed to the packing machine body 2 side by the rotating force of a feed roller (not shown) or the like.

In addition, a brake arm 3 is typically provided in the vicinity of the band reel 1 and the band B is fed to the packing machine body 2 side through a guide roller 3*a* of the brake arm 3.

In such a packing machine, in the case in which, in one packing step, the band is completely fed from the band reel 1 and is to be then returned and tightened, the rotation of the band reel 1 should be stopped immediately. Otherwise, an extra band is loosened so that a slack portion of the led band hangs and twist and entanglement problems are caused in the vicinity of the guide roller 3*a*.

It is conventional to stop the rotation of the band reel 1 immediately after the band is completely fed, by pushing a brake pad against the side surface of the band reel 1 to stop the rotation by means of the brake pad. It is also known to stop the rotation of the band reel 1 by urging a U-shaped brake belt 5 shown in FIG. 5, for example, against a brake pulley during braking, the brake pulley being attached to the peripheral surface of a reel shaft 4 pivotally supporting the band reel 1.

In the method using the brake pad, however, the force for stopping the rotation is small and the band reel 1 is rotated for a while even if a stop operation is started. In the method using the brake belt 5, moreover, there has been a problem in that the force for stopping the rotation is great but the braking is not stabilized if the intrusion of the V belt is poor.

SUMMARY OF THE INVENTION

In consideration of the above-mentioned circumstances, it is an object of the present invention to provide a brake structure of a band reel in a packing machine in which braking effects can be obtained reliably and responsiveness is excellent.

In order to achieve the above-mentioned object, the present invention provides a brake structure of a band reel in a packing machine which is provided on a reel shaft for being rotated integrally with a band reel, wherein a brake arm having a coil spring portion provided on one of its ends and a band passing ring portion provided on the other end is mounted on one of ends of the reel shaft and one of ends on a coil spring side in the brake arm is fastened to a fixed or stationary member such as a device frame, the coil spring portion receives force in a direction of an increase in a diameter by force applied from the fed band to form a clearance between an outer periphery of the reel shaft and an inner periphery of the coil spring, when the band inserted through the passing ring portion of the brake arm is sent toward a packing machine body side, and a diameter of the coil spring portion is reduced to closely engage an inner peripheral surface of the coil spring portion with an outer peripheral surface of the reel shaft, thereby stopping a rotation of the reel shaft by frictional force, when the force for feeding the band is released.

According to the present invention having such a structure, when the band feeding operation is ended, the rotation of the band reel can be stopped, and furthermore, the structure can be simplified.

According to the brake structure of the band reel in the packing machine in accordance with the present invention, if the force for leading out the band through the band feeding roller is released when the band is completely fed from the band reel, the diameter of the coil spring portion is reduced so that the rotation of the reel shaft can be stopped. Accordingly, the slack portion of the band can be prevented from hanging. In such a structure, moreover, only the coil spring is used. Therefore, the structure can be simplified and the responsiveness can also be enhanced.

These objects as well as other objects, features and advantages of the present invention will become more apparent to those skilled in the art from the following description with reference to the accompanying drawings.

DETAILED DESCRIPTION OF THE INVENTION

An embodiment of the present invention will be described below with reference to the drawings.

Figure 1:
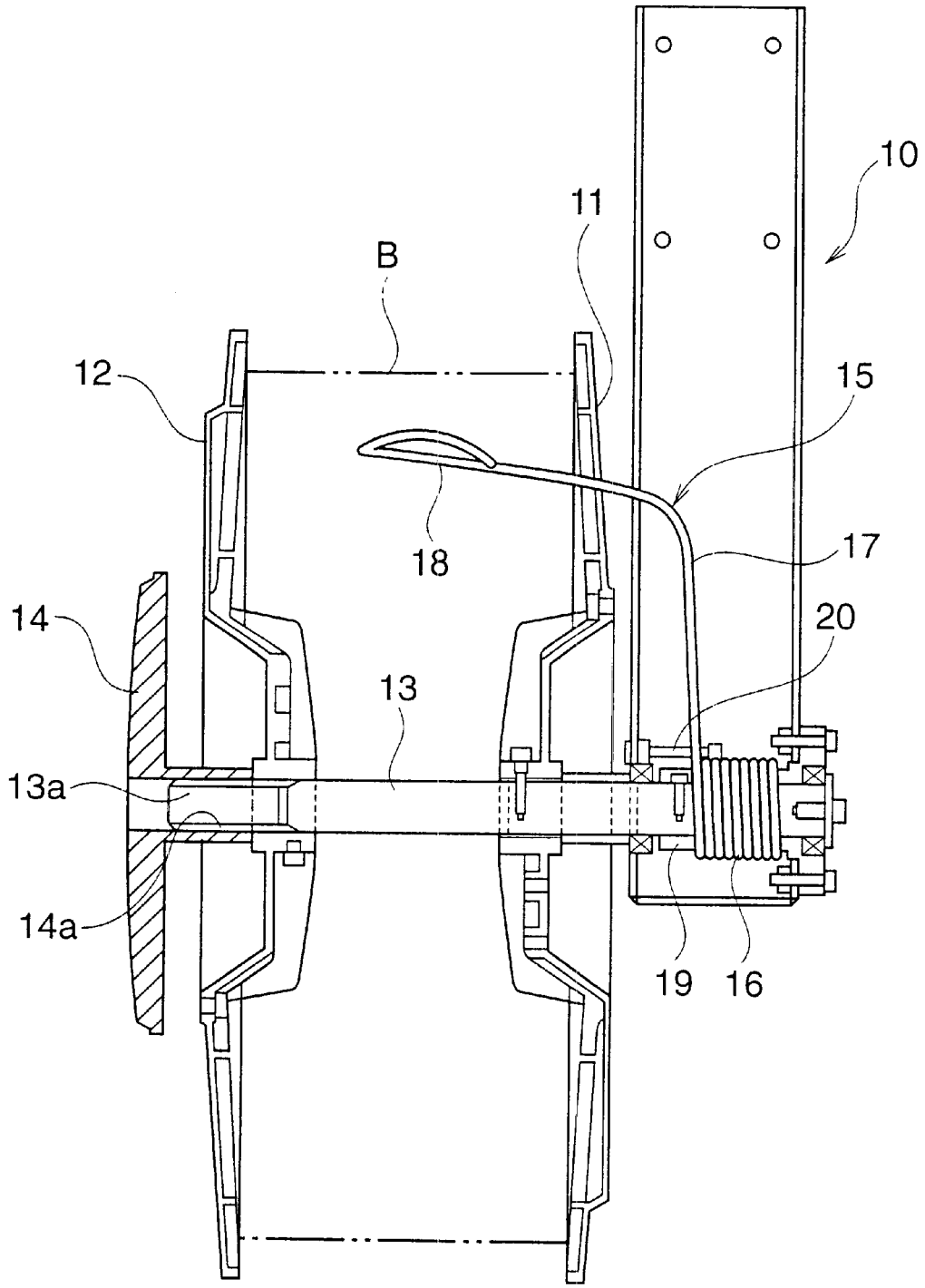
FIG. 1 is a sectional view showing a band reel comprising a brake structure according to an embodiment of the present invention.

FIG. 1 is a view showing a band reel comprising a brake structure according to a presently preferred embodiment of the present invention.

In a band reel 10, a band housing portion for winding a band B is formed by an inner circular 11, an outer circular 12 and a reel shaft 13. A male screw 13*a* is formed on the tip of the reel shaft 13 and a female screw 14*a* of a nut handle 14 is screwed into the male screw 13*a*.

Figure 3:
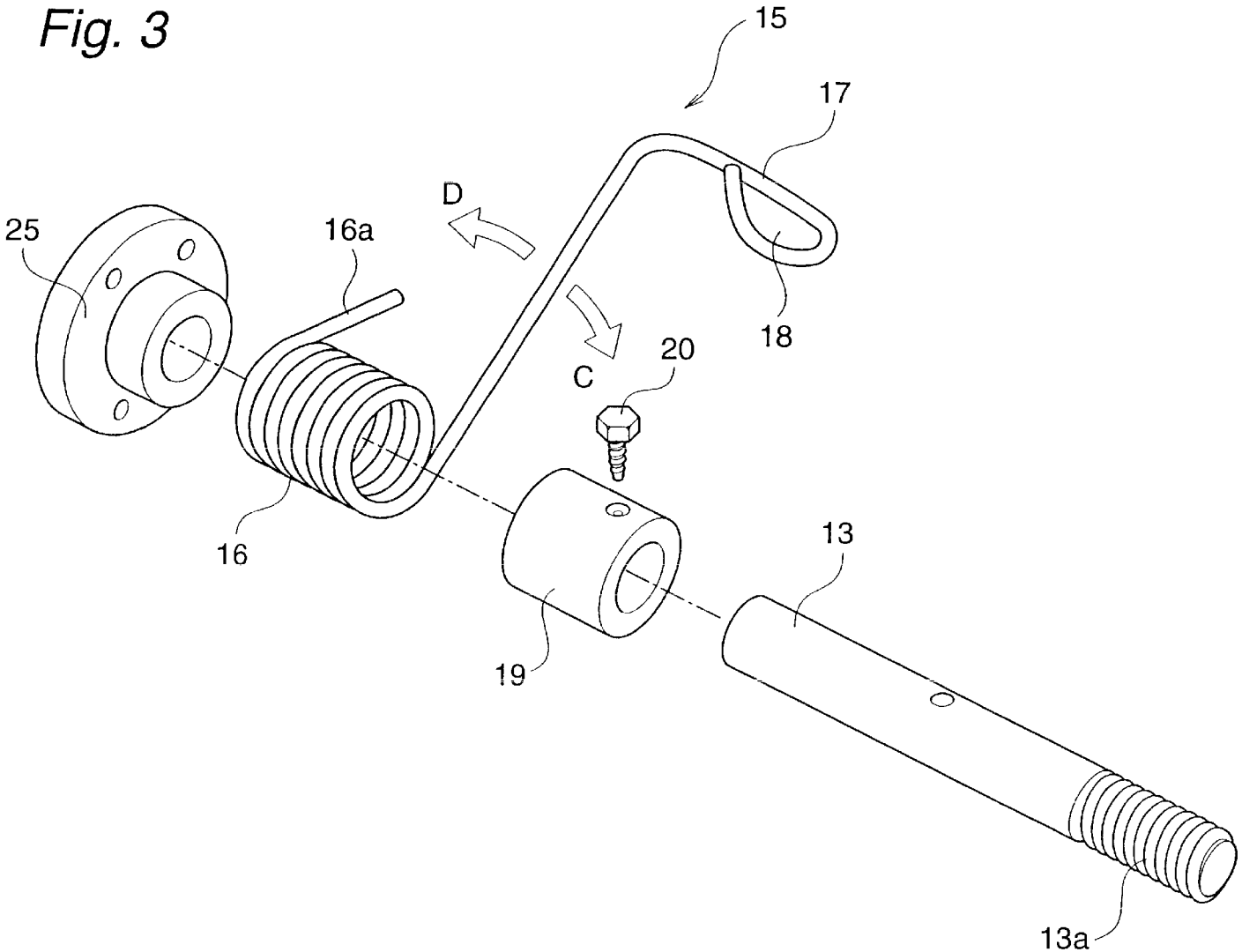
FIG. 3 is an exploded perspective view showing the brake structure according to the embodiment.
Figure 4:
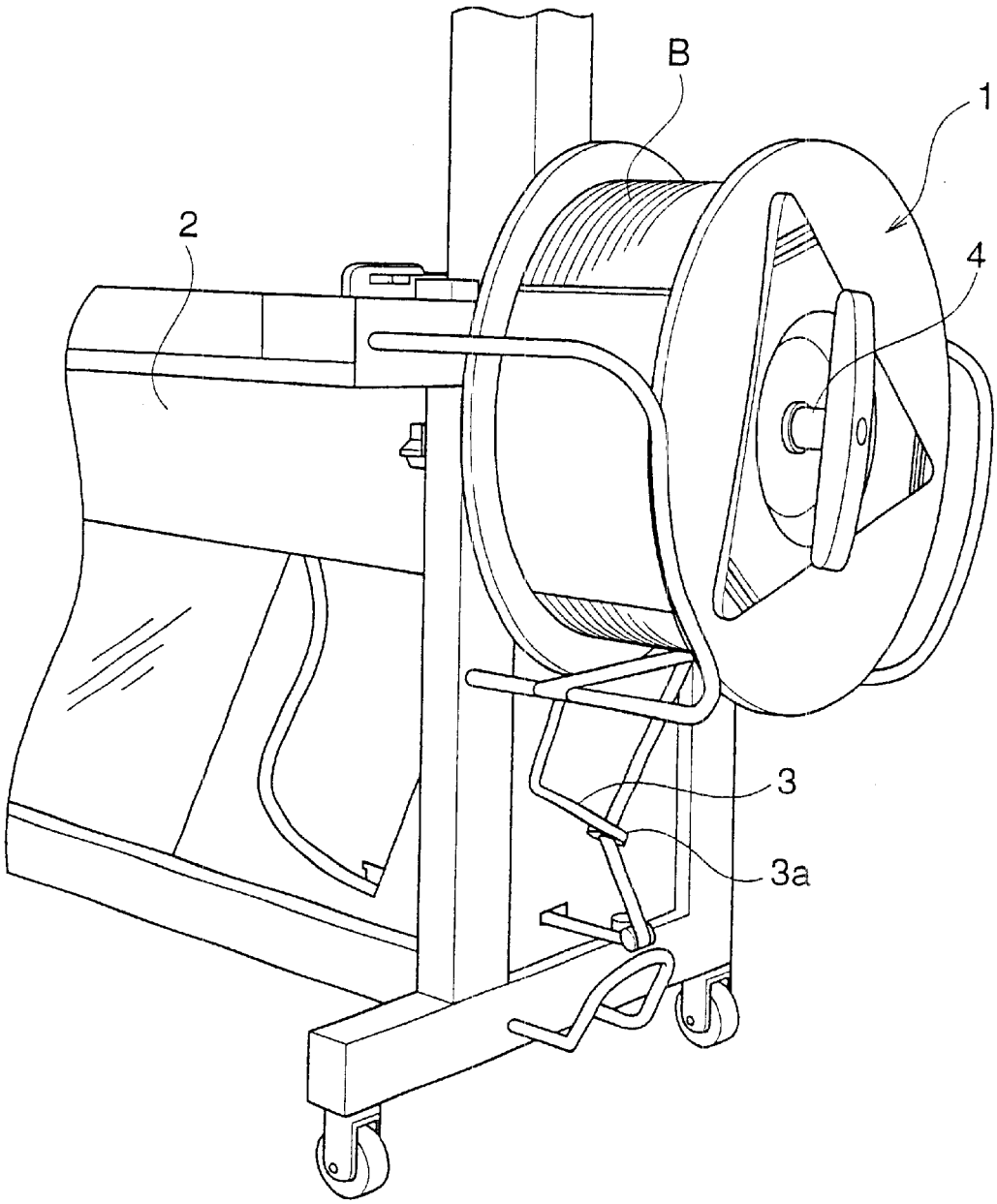
FIG. 4 is a perspective view showing a packing machine comprising a conventional band reel.
Figure 5:
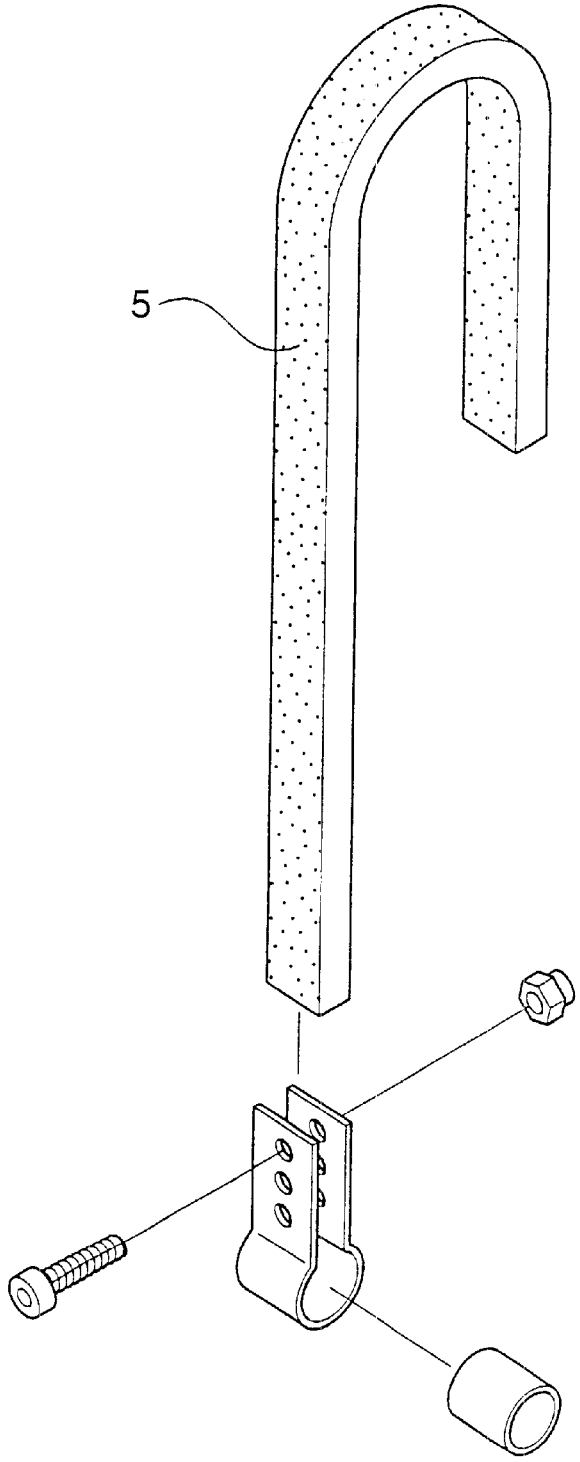
FIG. 5 is an exploded perspective view showing a brake structure constituted in the conventional band reel.

On the other side, a collar 19 is provided at one of ends of the reel shaft 13 which protrudes from the inner circular 11 as also shown in FIG. 3. The collar 19 is rotated integrally with the reel shaft 13 through a screw member 20 inserted between the collar 19 and the reel shaft 13. The base end side of a brake arm 15 according to the present embodiment is provided on the outer peripheral side of the collar 19.

The brake arm 15 has a coil spring portion 16 provided on the base end side and a dogleg-shaped arm portion 17 extending on the other end side. An end 16*a* of the coil spring portion 16, shown in FIG. 3, is fixed unrotatably to a reel bearing case 25 fastened to a device frame or the like. In addition, a passing ring portion 18 for guiding the band B is provided on the tip of the arm portion 17. The tip of the band B is caused to pass through the passing ring portion 18 and is then fed toward the packing machine body side.

Figure 2:
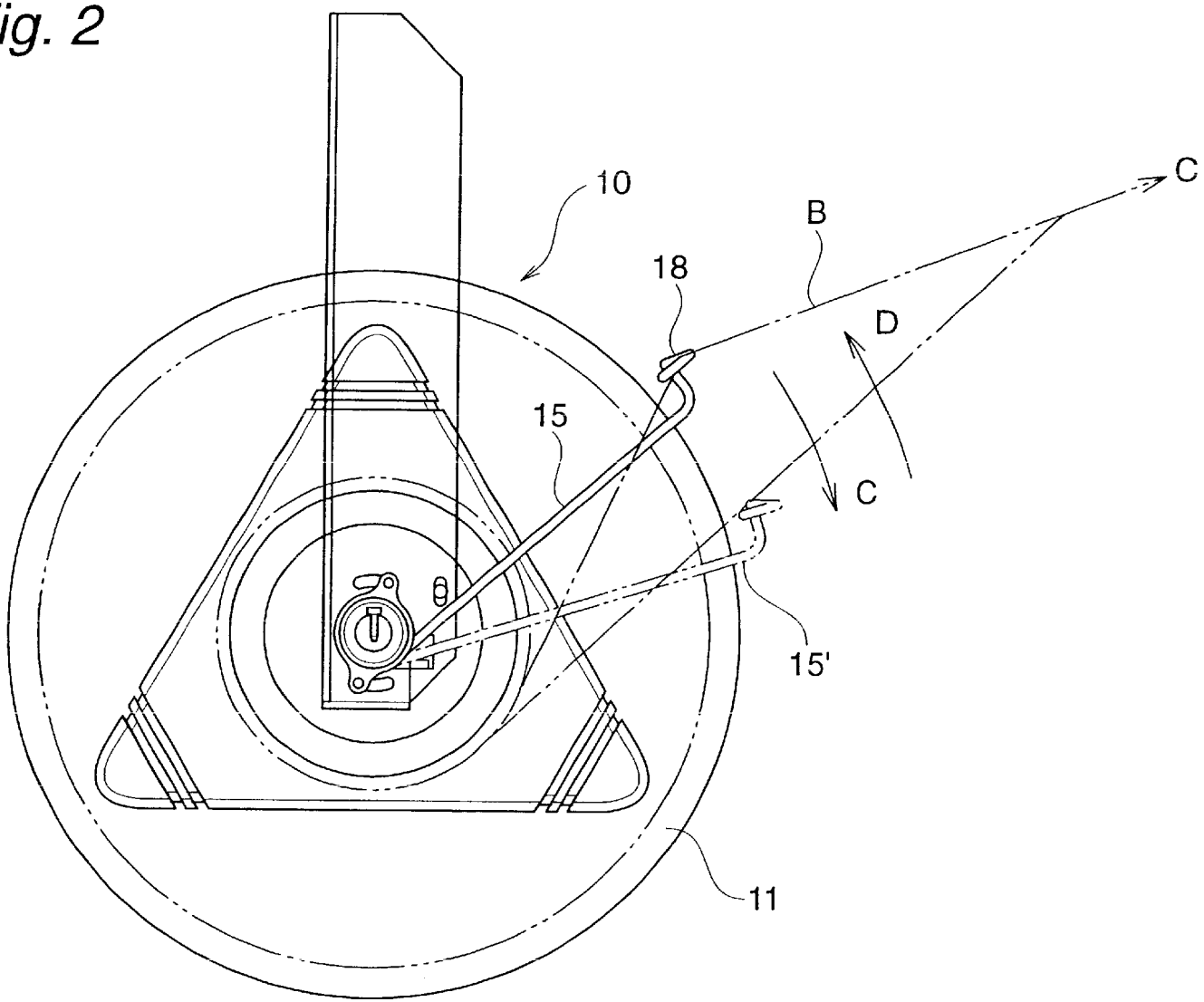
FIG. 2 is a front view showing the band reel.

In such a band reel 10, if the tip of the band B is pulled from the packing machine body side in a direction of an arrow C as shown in FIG. 2, the band B is led out. While the band B is led out, that is, band feeding means feeds the band B toward the packing machine body side, force in the direction of the arrow C acts on the brake arm 15 in FIG. 3. Accordingly, the diameter of the coil spring portion 16 is enlarged. Therefore, when the band B is fed toward the packing machine body side, a gap between the coil spring portion 16 and the collar 19 fixed to the reel shaft 13 is increased. Consequently, the reel shaft 13 rotates freely.

On the other hand, when the band B is completely fed, the force in the direction of the arrow C which pulls the brake arm 15 is released, and conversely, force in a direction of an arrow D acts on the coil spring portion 16 causing the coil spring portion 16 to return to the original position as shown in FIGS. 2 and 3. When the force thus acts in the direction of the arrow D, the coil spring portion 16 comes into contact with the peripheral surface of the collar 19 by pressure so that rotation of the collar 19 is forcibly stopped and the brake arm 15 is moved from a position shown in a broken line to a position shown in a solid line in FIG. 2.

Accordingly, if the rotation of the reel shaft 13 is stopped, the slack portion of the band is not led out any more. Consequently, the band can be prevented from hanging. In the case of an automatic machine, the tightening and returning steps are then started. The returned band is fed into a pool box of the packing machine body.

While the embodiment of the present invention has been described above, the present invention is not restricted to the embodiment.

The present invention can be applied to an automatic machine and a semi-automatic machine.

Numerous modifications and alternative embodiments of the present invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A brake structure of a band reel in a packing machine which is provided on a reel shaft for being rotated integrally with the band reel, comprising:

a brake arm positioned on one end of the reel shaft, the brake arm having a coil spring portion provided on one end and a band passing ring portion provided on another end, wherein the coil spring portion is integral with said brake arm, and wherein the one end of the brake arm having the coil spring portion is fastened to a fixed member, whereby when a band inserted through the band passing ring portion of the brake arm is sent toward a packing machine body side, the coil spring portion receives a force in a direction of an increase in a diameter of the coil spring portion by a force applied from the fed band causing the coil spring portion to diametrically expand to form a clearance between an outer periphery of the reel shaft and an inner periphery of the coil spring portion, and when the force applied from the fed band is released, the diameter of the coil spring portion is reduced to closely engage the inner periphery of the coil spring portion with the outer periphery of the reel shaft, thereby stopping a rotation of the reel shaft by frictional force.

* * * * *